US005649525A

United States Patent [19]

Koepf

[11] Patent Number: 5,649,525

[45] Date of Patent: Jul. 22, 1997

[54] QUIVER LIGHT

[76] Inventor: William A. Koepf, 7100 Holverson Rd., Carsonville, Mich. 48419

[21] Appl. No.: 678,986

[22] Filed: Jul. 12, 1996

[51] Int. Cl.[6] ..... F41B 5/06

[52] U.S. Cl. ..... 124/86; 124/25.5; 362/253

[58] Field of Search ..... 124/1, 23.1, 25.5, 124/25.7, 80, 86, 88; 362/102, 109, 253

[56] References Cited

U.S. PATENT DOCUMENTS

| | | | |
|---|---|---|---|
| 3,288,988 | 11/1966 | Boggs | 362/197 |
| 3,366,101 | 1/1968 | Saunders | 124/88 |
| 3,739,167 | 6/1973 | Avery | 362/157 |
| 4,340,930 | 7/1982 | Carissimi | 362/204 |
| 4,363,312 | 12/1982 | Spitzke | 124/45 |
| 4,399,498 | 8/1983 | Bacevius | 362/396 |
| 4,547,837 | 10/1985 | Bennett | 362/186 |
| 4,640,258 | 2/1987 | Penney et al. | 124/24.1 |
| 4,741,320 | 5/1988 | Wiard | 124/23.1 |
| 4,755,914 | 7/1988 | Bretl et al. | 362/109 |
| 4,895,329 | 1/1990 | Sloan | 248/229 |
| 4,995,372 | 2/1991 | Topel | 124/25.5 |
| 5,297,533 | 3/1994 | Cook | 124/88 |

*Primary Examiner*—John A. Ricci
*Attorney, Agent, or Firm*—Young & Basile, P.C.

[57] ABSTRACT

An archery quiver adapted to hold a plurality of arrows having heads and shafts is disclosed. The quiver comprises a housing having a portion for receiving the arrow heads and a rack member spaced from the housing and adapted to engage and grip the arrow shafts. A quiver shaft has two ends and is mounted at one end to the housing and at the other end to the rack member. A mechanism is provided for illuminating a desired area surrounding the quiver. A mechanism is further provided for permanently or removably mounting the illuminating mechanism on the housing such that the illuminating mechanism faces in a direction outward from the housing.

13 Claims, 3 Drawing Sheets

QUIVER LIGHT

BACKGROUND OF THE INVENTION

The present invention relates generally to archery quivers, and more particularly to such a quiver having a light formed thereon for illuminating a hunter's path.

Bow and arrow hunting is an art which has existed for centuries. In centuries past, the hunter was forced to stop hunting well before sundown since he had no means of illuminating his path after sundown, thus being unable to easily find his way home. In more modern history, hunters are not so limited since the advent of batteries and illuminating means such as flashlights and portable utility lamps.

However, the modern bow and arrow hunter must pack and carry a substantial amount of equipment necessary for the hunt. In doing so, often the hunter will forget to bring, or misplace the flashlight or other lighting mechanism. Generally, the hunter will not discover his situation until after the hunt, being deep in the woods after sundown. At that point, the hunter is in a predicament similar to hunters of centuries past, being forced to tread very carefully through the woods, relying only on the senses of hearing and feeling in order to grope his way out of the woods, often stumbling in the process.

Several attempts have been made to solve this problem. One of these is an archery shooting bow with a stabilizing flashlight such as that disclosed in U.S. Pat. No. 4,640,258 issued to Penney. However, for the stabilizer light to function properly, the bow must be pointed in the shooting position, i.e. wherever the bow is aimed, the light will shine. This would cause the hunter discomfort and fatigue if using this light to illuminate his path while walking through the woods after the hunt. Another problem with this light is the additional weight on the bow which is often undesirable.

Thus, it would be desirable to provide a means whereby it would be very difficult to forget or misplace the flashlight. Therefore, it is an object of the present invention to provide a light within a quiver which, when the quiver is mounted on a bow, will shine forward to light the hunter's path as he is carrying the bow at his side. This will advantageously prevent the hunter from forgetting the light, since the quiver is necessary equipment which is not easily forgotten. It would further be desirable to provide such a quiver light which will not interfere with the arrows being effectively contained within the quiver.

SUMMARY OF THE INVENTION

The present invention addresses and solves the problems enumerated above. The present invention comprises an archery quiver adapted to hold a plurality of arrows having heads and shafts. The quiver comprises a housing having a portion for receiving the arrow heads and a rack member spaced from the housing and adapted to engage and grip the arrow shafts. A quiver shaft has two ends and is mounted at one end to the housing and at the other end to the rack member. Means are provided for illuminating a desired area surrounding the quiver. Means are further provided for mounting the illuminating means on the housing such that the illuminating means faces in a direction outward from the housing.

BRIEF DESCRIPTION OF THE DRAWINGS

Other objects, features and advantages of the present invention will become apparent by reference to the following detailed description and drawings, in which.

DETAILED DESCRIPTION OF THE PREFERRED EMBODIMENTS

Figure 1:
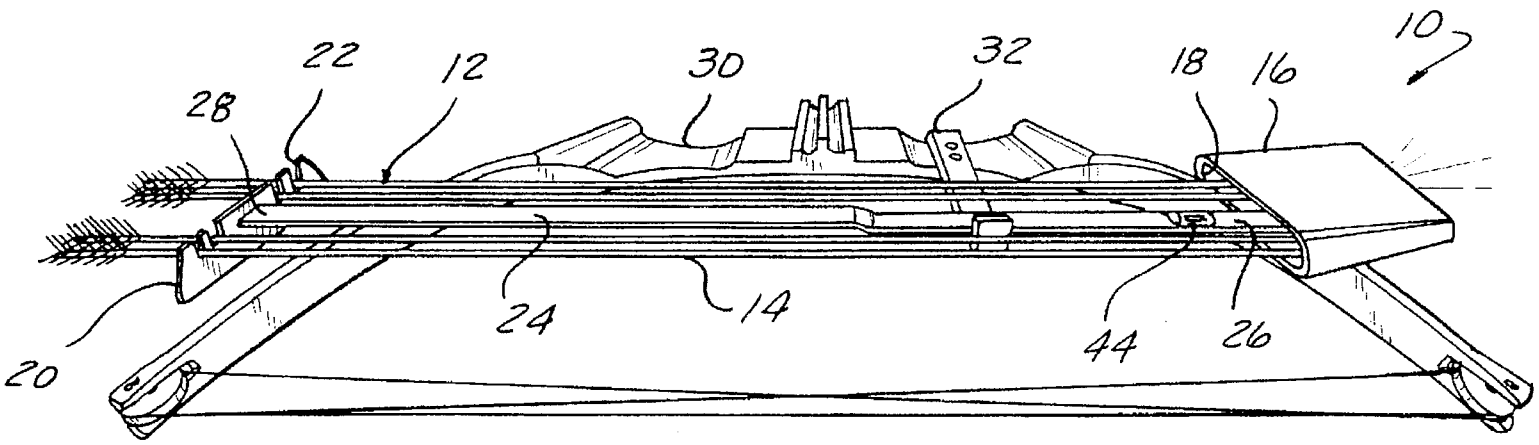
FIG. 1 is a perspective view showing one embodiment of the quiver light of the present invention, showing the quiver mounted on a compound bow.

Referring now to FIG. 1, the archery quiver of the present invention is designated generally as 10. Archery quiver 10 is adapted to hold a plurality of arrows 12 having heads and shafts 14. The quiver comprises a housing 16 having a portion 18 for receiving the arrow heads. A rack member 20 is spaced from housing 16 and is adapted to engage and grip arrow shafts 14, as by receiving slots 22. A quiver shaft 24 has two ends 26, 28 and is mounted at one end 26 to housing 16, and at the other end 28 to rack member 20.

Quiver 10 may be detachably mounted on a bow 30 as shown in FIG. 1. The quiver 10 may be detachably mounted as by any means conventionally known in the art, including as by a suitable mounting bracket 32.

Quiver 10 further comprises means for illuminating a desired area surrounding the quiver. It is to be understood that this illuminating means may comprise any suitable means. Means are also provided for mounting the illuminating means on the housing 16 such that the illuminating means faces in a direction outward from the housing (i.e. in a direction away from arrows 12). This mounting means may also comprise any suitable means.

Figure 6:
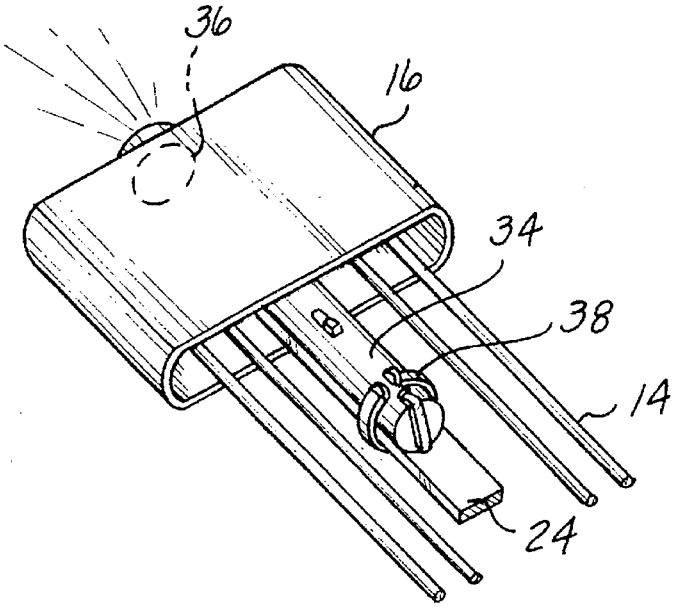
FIG. 6 is an enlarged, cutaway, perspective view of a further embodiment of the present invention, showing a flashlight secured to the quiver shaft by a clip.
Figure 7:
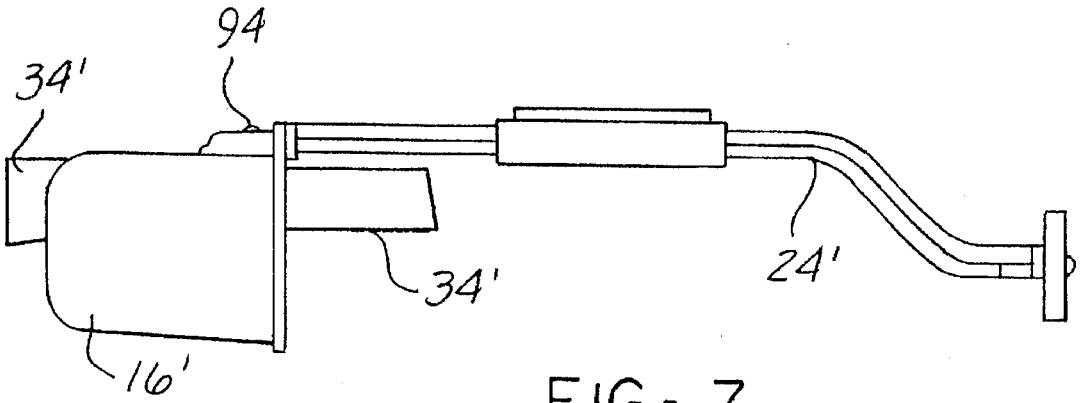
FIG. 7 is a side view of a further embodiment of the present invention.
Figure 8:
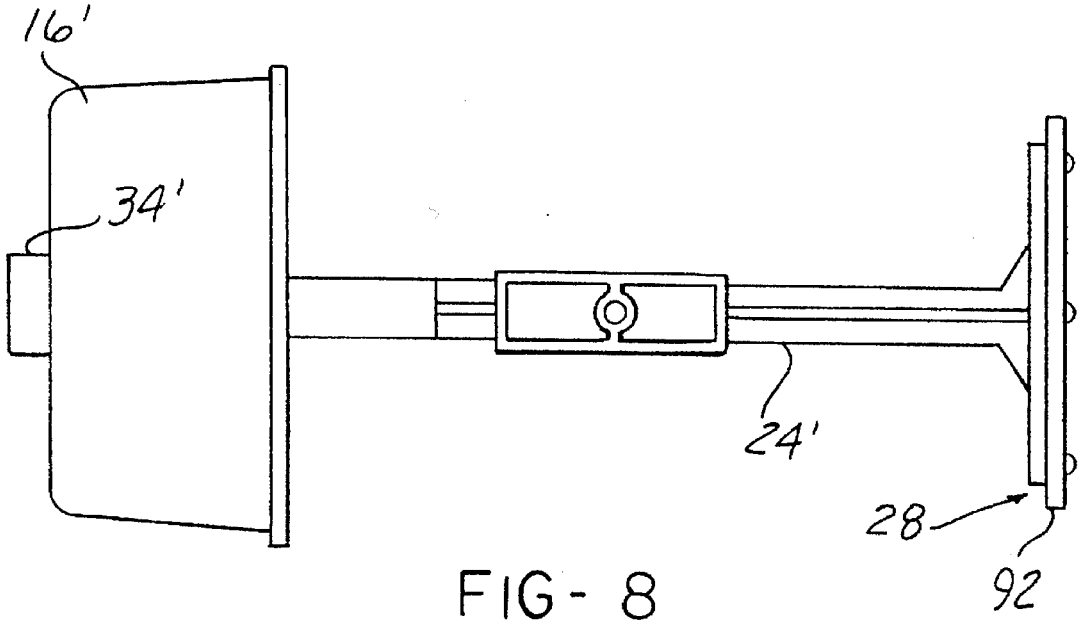
FIG. 8 is a bottom view of the embodiment shown in FIG. 7.
Figure 9:
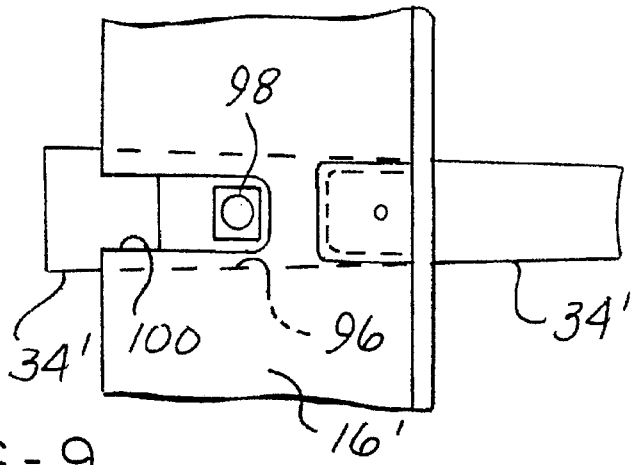
FIG. 9 is a partially broken away, cutaway top view showing the access to the on/off button of the flashlight.

In a preferred embodiment, the illuminating means is a flashlight 34 as shown in FIG. 6. In this embodiment, the mounting means comprises a through bore 36 defined in housing 16, for receiving flashlight 34, the through bore 36 being located at an end distal from rack member 20. Flashlight 34 is supported by quiver shaft 24. A clip 38, extendable around quiver shaft 24 and flashlight 34, detachably secures flashlight 34 to quiver 10. In an alternate embodiment, as shown in FIGS. 7–9, the quiver shaft 24' is formed from a molded polymeric material. It is to be understood that this may be any suitable material, however, in the preferred embodiment, it is formed from thermoplastic resin. A molded rubber grommet 92 may be fastened on the end 28 of quiver shaft 24, such as by a suitable screw assembly, in order to hold the arrow shafts 14. Housing 16' is press fit to quiver shaft 24, then fastened thereto, as by screw 94. As best seen in FIG. 9, the flashlight 34' snugly slides into a flashlight receiving recess 96 in housing 16' for an interference fit. The on/off button 98 of flashlight 34' is accessible through an opening 100 in the top surface of housing 16'.

Figure 2:
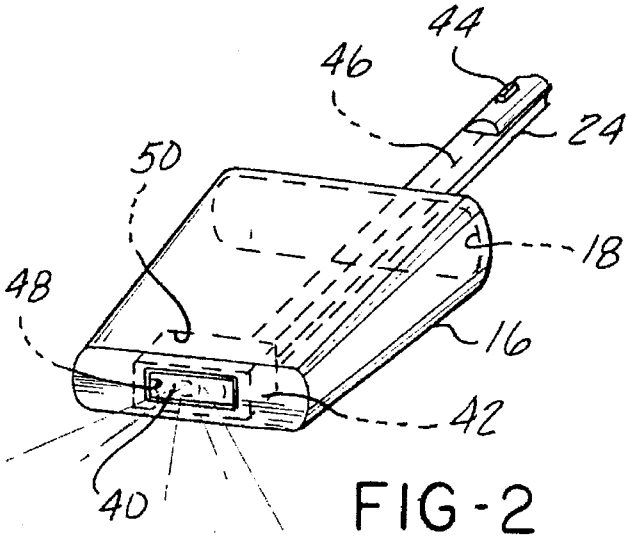
FIG. 2 is an enlarged, cutaway, perspective view of the embodiment of the quiver light shown in FIG. 1.

Referring now to FIG. 2, the illuminating means in an alternate preferred embodiment comprises a closeable electrical circuit having a lamp 40 and a battery assembly 42. Means, disposed on quiver 10, are provided for closing the circuit. This circuit closing means may comprise any suitable or conventionally known means. In the preferred embodiment, this closing means comprises a switch 44 mounted on quiver shaft 24 and connected to the lamp 40 and battery assembly 42 as by a suitable electrical conduit 46. In this embodiment, the mounting means comprises a through bore 48 defined in housing 16, through bore 48 being located at an end distal from rack member 20. Through bore 48 opens to, and communicates with a recess 50 integrally formed within housing 16, recess 50 being adapted to securely and closely receive lamp 40 and battery assembly 42. This embodiment is advantageous in that, since the illuminating assembly is actually integral with the quiver, it would be very hard to forget (unless the hunter actually forgot his quiver), and the battery assembly/switch mechanism allows for more optimal weight distribution and minimal interference with any arrows 12 contained within the quiver 10.

Figure 3:
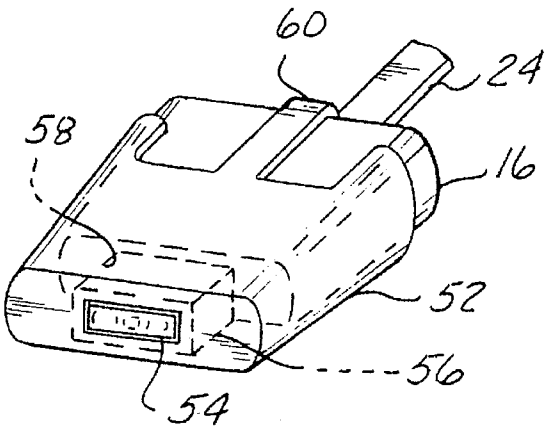
FIG. 3 is an enlarged, cutaway, perspective view of an alternate embodiment of the quiver light of the present invention.

Referring now to FIG. 3, the illuminating means in a further alternate embodiment comprises a lamp housing 52 and a closeable electrical circuit disposed within the lamp housing 52, the circuit having a lamp 54 and a battery assembly 56. Lamp 54 and battery assembly 56 are disposed within a recess 58 within lamp housing 52 in a manner similar to lamp 40 and battery assembly 42 as shown in FIG. 2. Means, disposed on lamp housing 52, are provided for closing the circuit. This circuit closing means may comprise any suitable means, such as any conventionally known switching means. In this embodiment, the mounting means comprises a mounting bracket 60 connected to lamp housing 52, mounting bracket 60 being removably engageable with quiver housing 16. This embodiment is advantageous in that it is mountable on a standard quiver without need for modification of the quiver.

Figure 4:
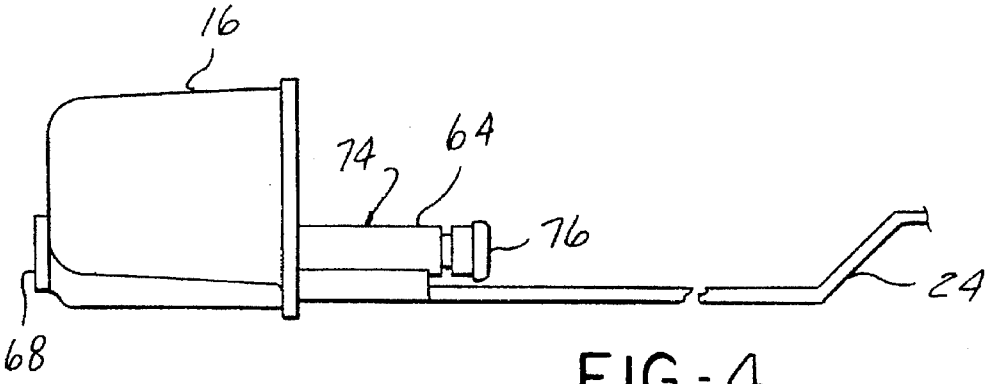
FIG. 4 is a cutaway side view of a further embodiment of the present invention.
Figure 5:
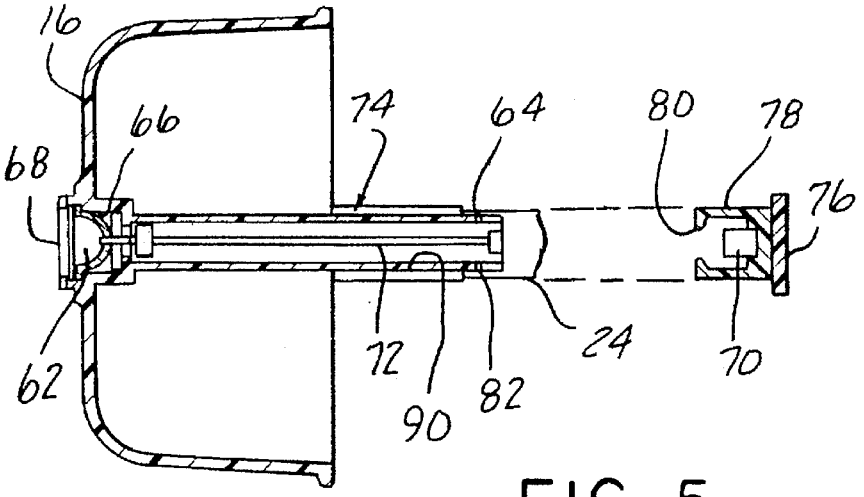
FIG. 5 is a cutaway cross sectional top view of the embodiment shown in FIG. 4 with the end cap exploded from the battery housing.

Referring now to FIGS. 4 and 5, a further preferred embodiment shows the illuminating means integrally formed with quiver 10. A lamp 62 is operatively connected to a battery assembly 64, lamp 62 being disposed within a lamp housing 74 and within a through bore 66 in housing 16. A recess 90 is formed within housing 16, the recess 90 adapted to securely and closely receive lamp housing 74. A lamp cap 68 is formed of a suitable light transmitting, polymeric material and is attached to the housing 16 and/or lamp housing 74. An end cap 76 having legs 78 with projections 80 is snap fit into groove 82. End cap 76 has a metal insert 70 which is removed in two areas. When end cap 76 is rotated and the metal insert 70 touches the metal shaft 72 in the casing, the electrical circuit is closed, thereby illuminating lamp 62.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. An archery quiver adapted to hold a plurality of arrows having heads and shafts, the quiver comprising:

a housing having a portion for receiving the arrow heads;

a rack member spaced from the housing and adapted to engage and grip the arrow shafts;

a quiver shaft having two ends and being mounted at one end to the housing and at the other end to the rack member;

means for illuminating a desired area surrounding the quiver; and means for mounting the illuminating means on the housing such that the illuminating means faces in a direction outward from the housing.

2. The archery quiver as defined in claim 1 wherein the quiver is detachably mounted on a bow.

3. The archery quiver as defined in claim 1 wherein the illuminating means is a flashlight.

4. The archery quiver as defined in claim 3 wherein the mounting means comprises:

a through bore defined in the housing, for receiving the flashlight, the through bore being located at an end distal from the rack member, the flashlight being supported by the quiver shaft; and a clip, extendable around the quiver shaft and the flashlight, for detachably securing the flashlight to the quiver.

5. The archery quiver as defined in claim 1 wherein the illuminating means comprises:

a closeable electrical circuit having a lamp and a battery assembly; and means, disposed on the quiver, for closing the electrical circuit.

6. The archery quiver as defined in claim 5 wherein the closing means comprises a switch mounted on the quiver shaft.

7. The archery quiver as defined in claim 5 wherein the mounting means comprises a through bore defined in the housing, the through bore being located at an end distal from the rack member, the through bore opening to, and communicating with a recess formed within the housing, the recess adapted to securely and closely receive the lamp.

8. The archery quiver as defined in claim 1 wherein the illuminating means comprises:

a lamp housing;

a closeable electrical circuit disposed within the lamp housing, the electrical circuit having a lamp and a battery assembly; and means, disposed on the lamp housing, for closing the electrical circuit.

9. The archery quiver as defined in claim 8 wherein the electrical circuit closing means comprises:

an end cap rotatably mounted on the lamp housing at an end distal from the lamp;

an electrical conduit extending between the lamp and the battery assembly; and a metal insert disposed within the end cap and adapted to selectively contact the electrical conduit upon rotation in order to close the electrical circuit.

10. The archery quiver as defined in claim 9 wherein the lamp housing is integrally formed with the quiver.

11. The archery quiver as defined in claim 8 wherein the mounting means comprises a mounting bracket connected to the lamp housing, the mounting bracket removably engageable with the quiver housing.

12. An archery quiver adapted to hold a plurality of arrows having heads and shafts, the quiver comprising:

a housing having a portion for receiving the arrow heads;

a rack member spaced from the housing and adapted to engage and grip the arrow shafts;

a quiver shaft having two ends and being mounted at one end to the housing and at another end to the rack member;

means for illuminating a desired area surrounding the quiver, wherein the illuminating means comprises:

a lamp housing, the lamp housing being integrally formed with the quiver;

a closeable electrical circuit disposed within the lamp housing, the electrical circuit having a lamp and a battery assembly; and means, disposed on the lamp housing, for closing the electrical circuit, wherein the electrical circuit closing means comprises:

an end cap rotatably mounted on the lamp housing at an end distal from the lamp;

an electrical conduit extending between the lamp and the battery assembly; and a metal insert disposed within the end cap and adapted to selectively contact the electrical conduit upon rotation in order to close the electrical circuit; and means for mounting the illuminating means on the housing such that the illuminating means faces in a direction outward from the housing, wherein the mounting means comprises a through bore defined in the housing, the through bore being located at an end distal from the rack member, the lamp being disposed within the through bore, and a recess formed within the housing, the recess adapted to securely and closely receive the lamp housing.

13. An archery quiver detachably mountable on a bow and adapted to hold a plurality of arrows having heads and shafts, the quiver comprising:

a housing having a portion for receiving the arrow heads;

a rack member spaced from the housing and adapted to engage and grip the arrow shafts;

a quiver shaft having two ends and being mounted at one end to the housing and at the other end to the rack member;

means for illuminating a desired area surrounding the quiver, the illuminating means comprising:

a closeable electrical circuit having a lamp and a battery assembly; and a switch, mounted on the quiver shaft, for closing the electrical circuit; and means for mounting the illuminating means on the housing such that the illuminating means faces in a direction outward from the housing, the mounting means comprising:

a through bore defined in the housing, the through bore being located at an end distal from the rack member, the through bore opening to, and communicating with a recess formed within the housing, the recess adapted to securely and closely receive the lamp.

* * * * *